US009490554B2

(12) United States Patent
Brown

(10) Patent No.: US 9,490,554 B2
(45) Date of Patent: Nov. 8, 2016

(54) ASSEMBLY AND INTERCONNECTION METHOD FOR HIGH-POWER LED DEVICES

(75) Inventor: Michael H. Brown, River Falls, WI (US)

(73) Assignee: Air Motion Systems, Inc., River Falls, WI (US)

( * ) Notice: Subject to any disclaimer, the term of this patent is extended or adjusted under 35 U.S.C. 154(b) by 207 days.

(21) Appl. No.: 13/618,980

(22) Filed: Sep. 14, 2012

(65) Prior Publication Data

US 2013/0087722 A1 Apr. 11, 2013

Related U.S. Application Data

(60) Provisional application No. 61/535,541, filed on Sep. 16, 2011.

(51) Int. Cl.

| | |
|---|---|
| ***H01R 11/09*** | (2006.01) |
| ***H01R 4/36*** | (2006.01) |
| ***F21V 19/00*** | (2006.01) |
| ***F21V 19/04*** | (2006.01) |
| ***F21V 23/06*** | (2006.01) |
| *F21S 2/00* | (2016.01) |

(Continued)

(52) U.S. Cl.

CPC . *H01R 4/36* (2013.01); *F21S 4/28* (2016.01); *F21V 19/0055* (2013.01); *F21V 19/045* (2013.01); *F21V 23/06* (2013.01); *F21S 2/005* (2013.01); *F21Y 2101/02* (2013.01); *F21Y 2105/001* (2013.01); *H01R 11/09* (2013.01); *Y10T 29/49002* (2015.01)

(58) Field of Classification Search

CPC .. F21V 19/0055; F21V 19/045; F21V 23/06; F21S 4/28; F21S 2/005; H01R 4/36; H01R 11/09; F21Y 2101/02; F21Y 2105/001; Y10T 29/49002; H05B 33/06

See application file for complete search history.

(56) References Cited

U.S. PATENT DOCUMENTS

| | | | | |
|---|---|---|---|---|
| 5,720,622 | A * | 2/1998 | Ishikawa | H01R 13/2414 439/86 |
| 7,201,511 | B2 * | 4/2007 | Moriyama et al. | 362/646 |
| 2001/0053636 | A1 * | 12/2001 | Tamai et al. | 439/677 |

(Continued)

FOREIGN PATENT DOCUMENTS

| | | |
|---|---|---|
| JP | 2008-112883 | 5/2008 |

OTHER PUBLICATIONS

Notification of Transmittal of the International Search Report and the Written Opinion of the International Searching Authority for PCT/US2012/055568, the PCT counterpart application of this application.

(Continued)

*Primary Examiner* — Anh Mai
*Assistant Examiner* — Fatima Farokhrooz
(74) *Attorney, Agent, or Firm* — Skaar Ulbrich Macari, P.A.

(57) ABSTRACT

An LED array with a plurality of easily replaceable LED assemblies. The LED assemblies are attached to a mounting substrate, e.g., by threaded, electrically insulative fasteners. The LED assemblies are electrically connected in a series by detachable power connect clamps and interconnect clamps. It is emphasized that this abstract is provided to comply with the rules requiring an abstract that will allow a searcher or other reader to quickly ascertain the subject matter of the technical disclosure. It is submitted with the understanding that it will not be used to interpret or limit the scope or meaning of the claims.

16 Claims, 8 Drawing Sheets

(51) Int. Cl.
*F21Y 101/02* (2006.01)
*F21Y 105/00* (2016.01)

(56) References Cited

U.S. PATENT DOCUMENTS

2004/0021146 A1 2/2004 Fujiwara
2004/0113268 A1* 6/2004 Shirakawa ..... H01L 23/5383 257/724
2005/0030765 A1* 2/2005 Southard ..... G09F 9/33 362/559
2005/0221659 A1 10/2005 Mrakovich
2005/0269587 A1* 12/2005 Loh et al. ..... 257/99
2008/0278941 A1 11/2008 Logan
2010/0149809 A1 6/2010 Ruud
2011/0068708 A1* 3/2011 Coplin et al. ..... 315/294
2012/0176795 A1* 7/2012 Lynch ..... 362/249.02
2012/0326183 A1* 12/2012 Min ..... 257/88

OTHER PUBLICATIONS

International Search Report for PCT/US2012/055568, the PCT counterpart application of this application.
Written Opinion of the International Searching Authority for PCT/US2012/055568, the PCT counterpart application of this application.

* cited by examiner

ASSEMBLY AND INTERCONNECTION METHOD FOR HIGH-POWER LED DEVICES

CROSS-REFERENCES TO RELATED APPLICATIONS

This application claims priority under 35 U.S.C. §119 (e) to, and hereby incorporates by reference, U.S. Provisional Application No. 61/535,541, filed 16 Sep. 2011.

BACKGROUND OF THE INVENTION

1. Field of the Invention

This invention relates to LED arrays and, in particular, this invention relates to LED arrays with interchangeable LED assemblies.

2. Background

High intensity Light Emitting Diode ("LED") devices present great challenges in designing thermal energy management, optical energy management, and electrical energy management (interconnection). This is a particular problem when designing LED light-emitting systems, which focus high levels of specific wavelength light energy at relatively short distances, such as 10 mm-100 mm. These designs require high-density packaging (mounting) of the LED devices. A method is therefore needed to electrically interconnect existing LED "package" designs to meet the high density, as well as electrical energy, management goals. Because of the high intensity light energy, materials used must withstand the energy emitted at the particular wavelength of the applicable device or system.

There is then a need for an LED package, which produces high-intensity radiant energy emitted from a high-density LED array. There is a particular need for an LED package, which can be quickly and easily repaired on-site or altered to provide varying wavelengths of radiant energy.

SUMMARY OF THE INVENTION

This invention substantially meets the aforementioned needs of the industry by providing an LED array with easily and quickly replaceable LED assemblies.

There is provided an LED array comprising a mounting substrate, a plurality of LED assemblies, a plurality of power connect clamps, and a plurality of interconnect clamps. The LED assemblies are attached to the substrate and each have positive and negative electrodes electrically connected to an LED chip. The power connect clamps connect each of a pair of terminal LED assemblies to an electrical power source. The power connect clamps may include a power connect fastener threaded into a power connect aperture. The power connect fastener may be threaded into an electrical connector to connect each of the power connect clamps to the power source. The interconnect clamps connect positive and negative electrodes adjacent LED assemblies such that the LED assemblies are interconnected in an electrical series. Each of the interconnect clamps may have a pair of interconnect fasteners, each of the interconnect fasteners threaded into an interconnect aperture. The interconnect fastener may be threaded against a positive or negative electrode to connect and secure the positive and negative electrodes adjacent LED assemblies into the electrical series.

It is understood that the above-described figures are only illustrative of the present invention and are not contemplated to limit the scope thereof.

DETAILED DESCRIPTION

Unless otherwise defined, all technical and scientific terms used herein have the same meaning as commonly understood by one of ordinary skill in the art to which this invention belongs. Although methods and materials similar or equivalent to those described herein can be used to practice the invention, suitable methods and materials are described below.

Any references to such relative terms as top and bottom or the like are intended for convenience of description and are not intended to limit the present invention or its components to any one positional or spatial orientation. All dimensions of the components in the attached figures may vary with a potential design and the intended use of an embodiment of the invention without departing from the scope of the invention.

Each of the additional features and methods disclosed herein may be utilized separately or in conjunction with other features and methods to provide improved devices of this invention and methods for making and using the same. Representative examples of the teachings of the present invention, which examples utilize many of these additional features and methods in conjunction, will now be described in detail with reference to the drawings. This detailed description is merely intended to teach a person of skill in the art further details for practicing preferred aspects of the present teachings and is not intended to limit the scope of the invention. Therefore, only combinations of features and methods disclosed in the following detailed description may not be necessary to practice the invention in the broadest sense, and are instead taught merely to particularly describe representative and preferred embodiments of the invention.

A person of ordinary skill in the art will readily appreciate that individual components shown on various embodiments of the present invention are interchangeable to some extent and may be added or interchanged on other embodiments without departing from the spirit and scope of this invention.

Figure 1:
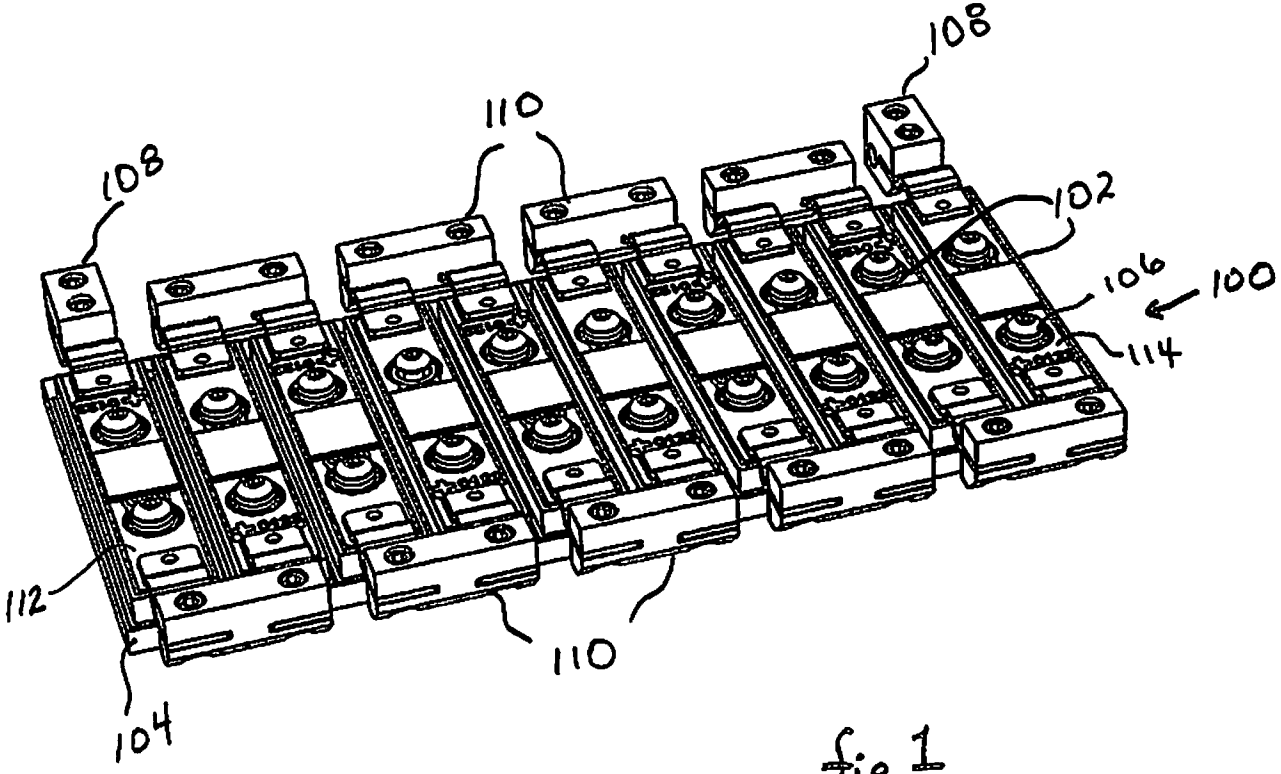
FIG. 1 is a perspective view of one embodiment of the LED array of this invention.

Referring to FIG. 1, an LED (assembly) array 100 is shown. The LED array 100 includes a plurality of LED assemblies 102 attached to a mounting substrate 104 with a plurality of fasteners such as mounting screws 106. Power is provided to the LED array 100 by means of power connect clamps 108 and the LED assemblies 102 are interconnected using interconnect clamps 110. One of the end or terminal LED assemblies 112, 114 are disposed at each end of the LED array 100.

Figure 2:
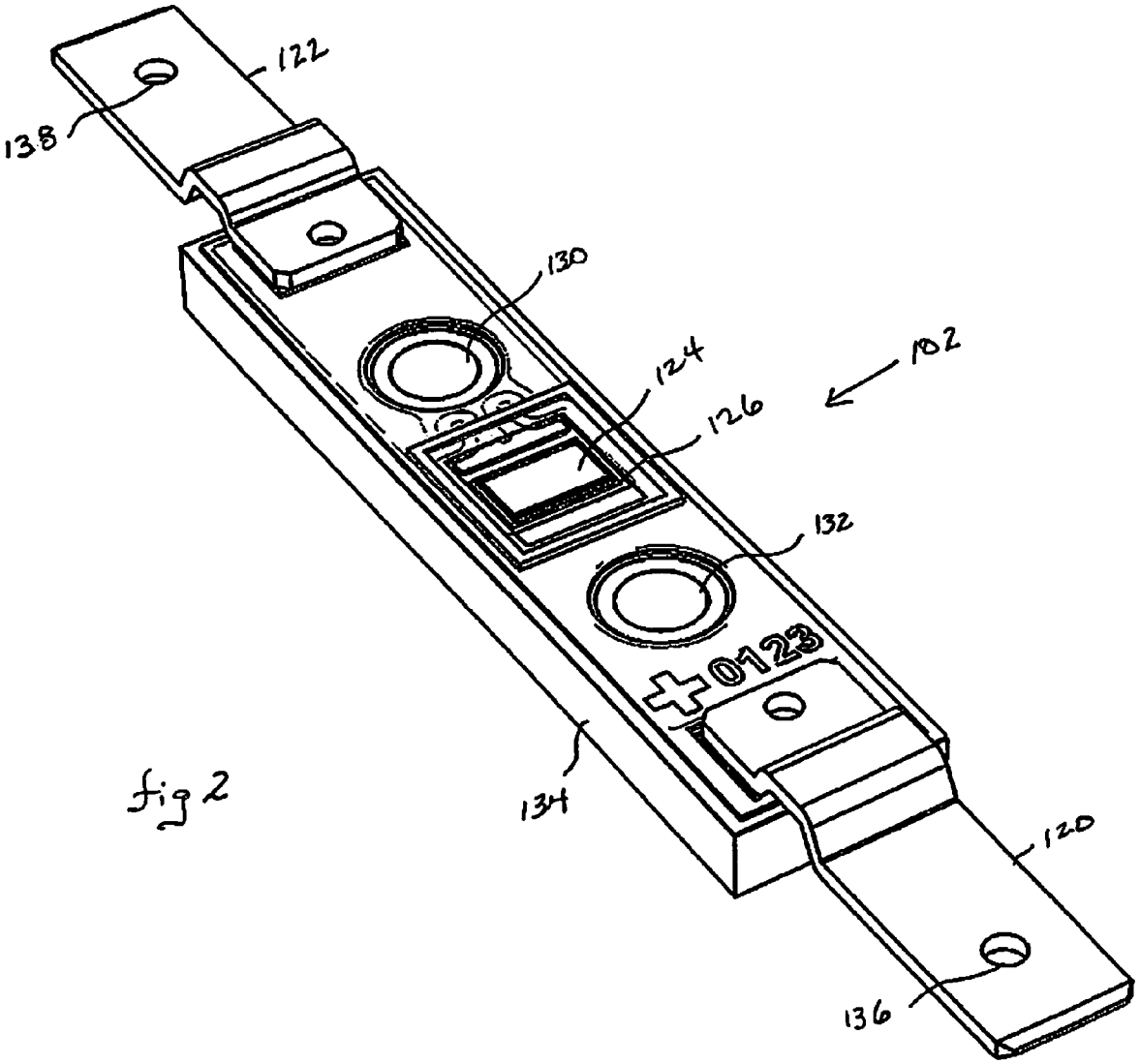
FIG. 2 is a perspective view of one embodiment of an LED assembly utilized in the LED array of FIG. 1.
Figure 3:
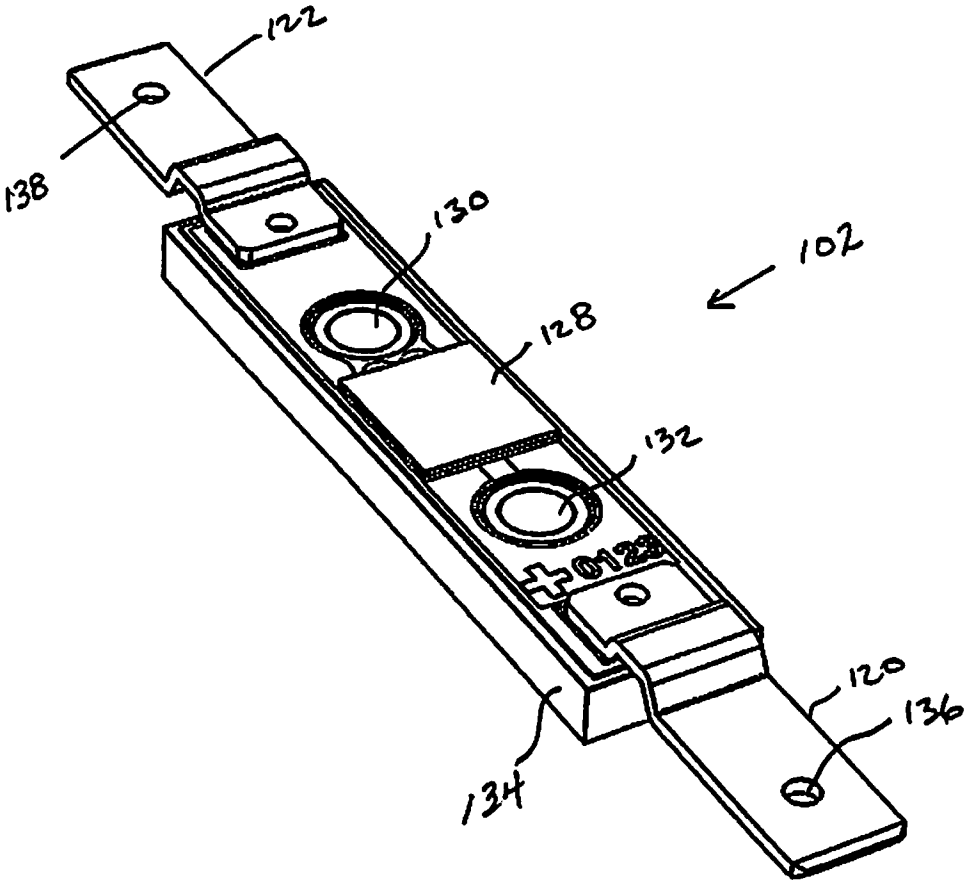
FIG. 3 is a perspective view of the LED assembly of FIG. 2 with a lens in place covering the LED chip.

FIGS. 2 and 3 show one embodiment of an LED assembly 102. One suitable LED assembly is available from Luminus Devices, Inc., 1100 Technology Park Drive, Billerica, Mass. 01821 USA, as part number SCBT-120-UV-C14-1382-22. This LED assembly emits electromagnetic radiation primarily in the UV spectrum, with a peak wavelength of 385 nm. The LED assembly 102 has positive and negative electrodes 120, 122, and an LED (chip) 124 in electrical communication with the positive and negative electrodes 120, 122, at least partially by means of an electrical connector (wire) assembly 126. In the embodiment depicted in FIG. 3 the LED 124 is covered by a lens 128. The lens 128 may transmit essentially all radiation emitted from the LED 124 or optionally may filter out selected wave lengths. Apertures 130, 132 are defined in the base 134. In the embodiment shown the positive and negative electrodes extend from opposite longitudinal ends of the base 134. Mounting apertures 136, 138 are defined in respective positive and negative electrodes 120, 122. Other components and features of the LED assembly 102 are known to persons of ordinary skill in the art and are not described herein.

Figure 4:
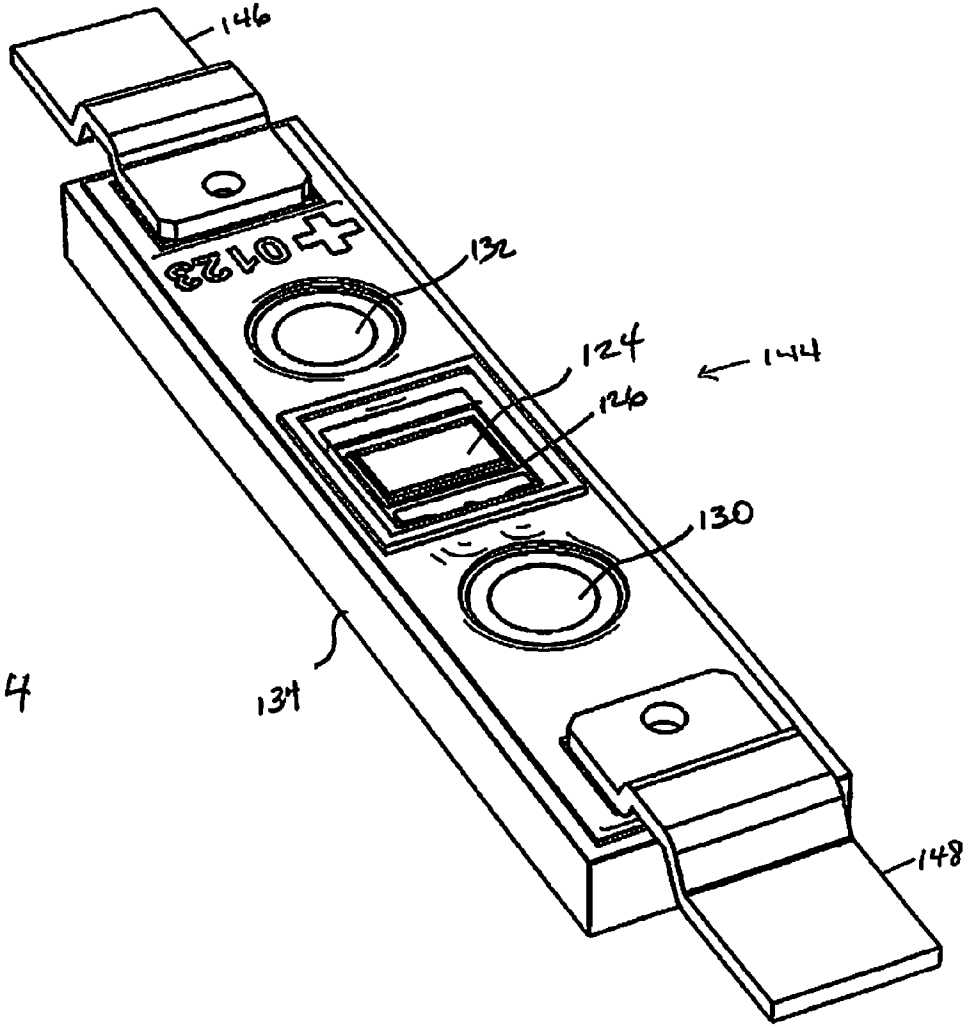
FIG. 4 is a perspective view of another embodiment of an LED assembly suitable for use in the LED array of FIG. 1.

FIG. 4 shows an LED assembly 144, the LED assembly differing from the LED assembly 102 by the presence of respective positive and negative electrodes 146, 148. The electrodes 146 148 differ from the electrodes 120, 122 in that the electrodes 146, 148 are truncated and lack the apertures 136, 138.

Figure 5:
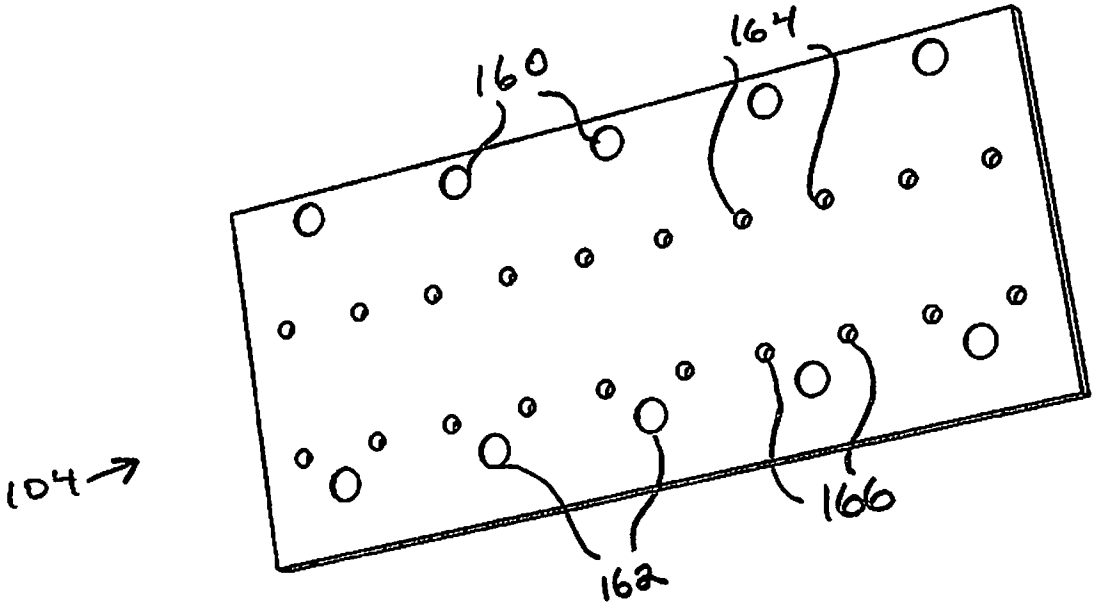
FIG. 5 is a perspective view of a bottom side of a mounting substrate suitable for use with the LED array of FIG. 1.
Figure 6:
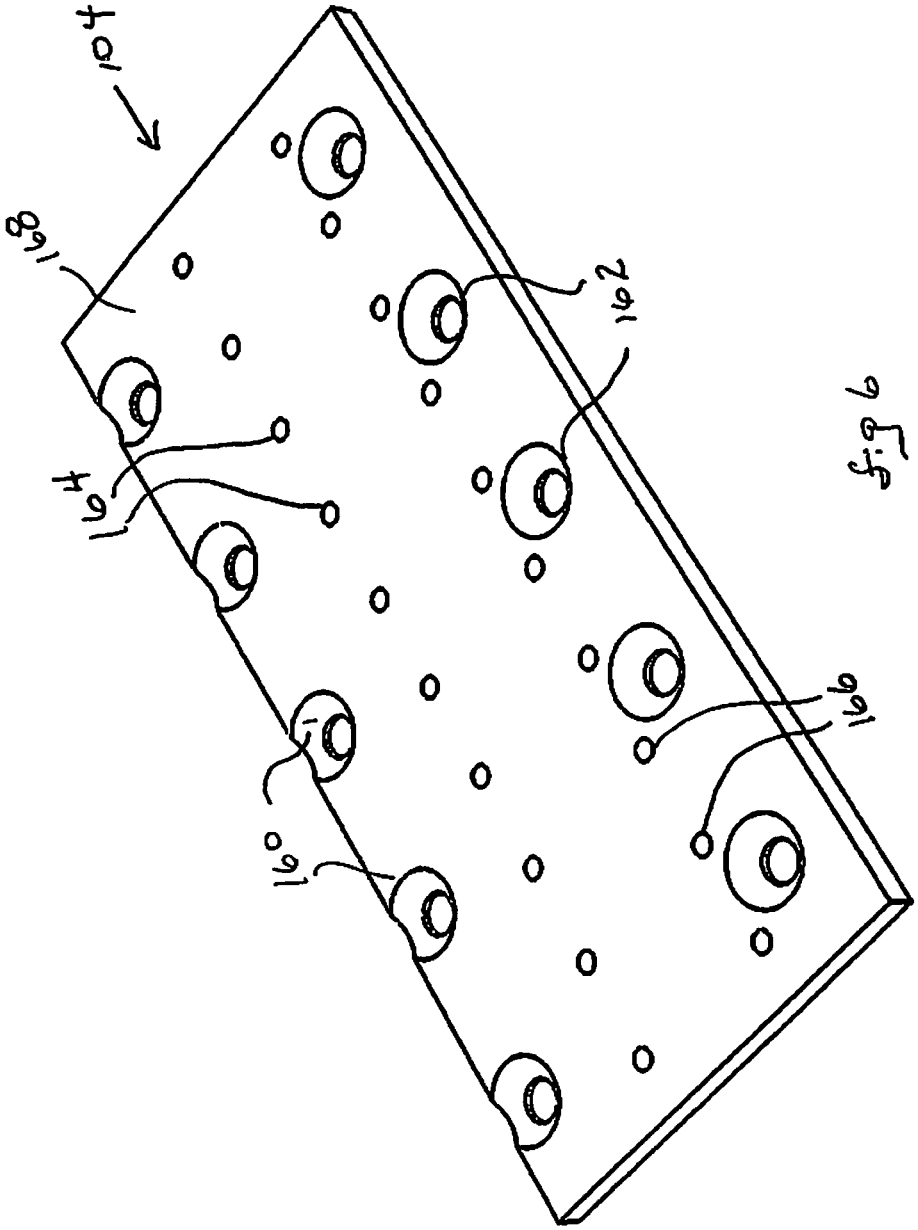
FIG. 6 is a perspective view of a top side of the mounting substrate of FIG. 5.

FIGS. 5 and 6 show bottom and top surfaces of the mounting substrate 104, respectively. The mounting substrate 104 defines a plurality of mounting apertures 160, 162 and LED affixing apertures 164, 166. In the embodiment depicted, the apertures 160, 160 are countersunk, so that connectors, such as nuts can be used to flush-attach the mounting substrate 104 to a surface, such as present in a printing press. The countersink feature allows the affixed nuts to be flush with or be entirely below the top surface 168 and, thereby, permit LED assemblies to be mounted flat against the mounting substrate 104. Thus, the countersink feature permits LED assemblies to fully contact the top surface 168 when attached thereto. The mounting substrate 104 may be formed from a conductive material, such as copper, aluminum, or the like.

Figure 7:
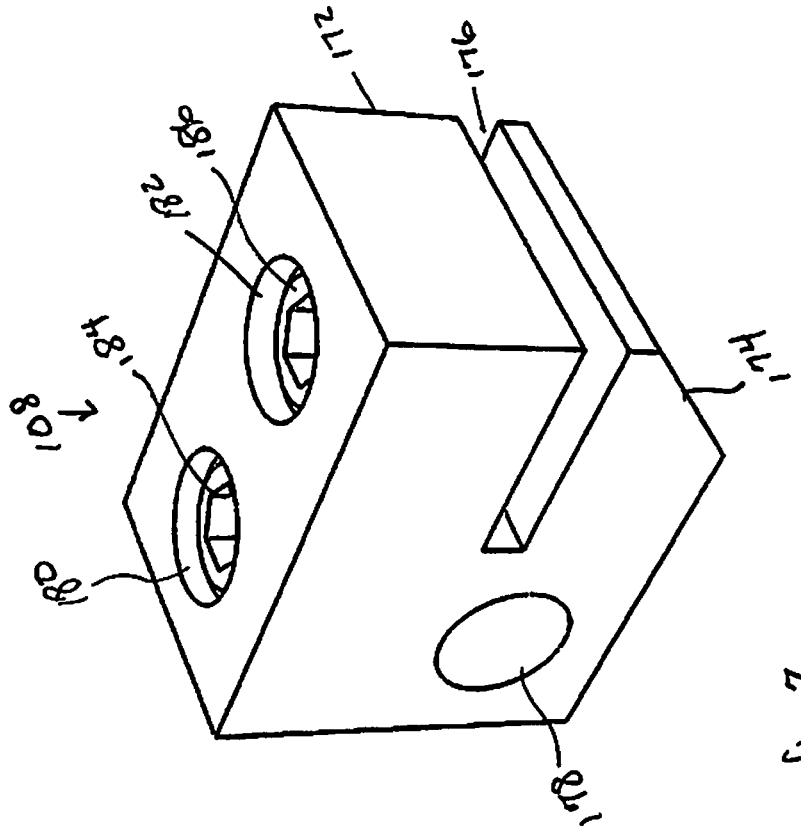
FIG. 7 is a perspective view of one embodiment of a power connect clamp used in the LED array of FIG. 1.

As shown in FIG. 7, one embodiment of a power connect clamp 108 has respective upper and lower portions 172, 174. A power connect clamp slot 176 is defined between the upper and lower portions 172, 174. In the embodiment shown, the lower portion 174 is tapered to a maximum dimension adjacent the slot 176. A power connect clamp aperture 178 is defined laterally adjacent the slot 176. Threaded power connect clamp apertures 180, 182 are also formed in the upper portion 172. The threaded apertures 180, 182 accommodate power connect fasteners such as power connect set screws 184, 186 or equivalent connectors. In the embodiment depicted, the aperture 180 opens into the aperture 178. As in the case of the mounting substrate 104, the clamp 108 may be formed from an electrically conductive material, such as copper, aluminum, or the like.

Figure 8:
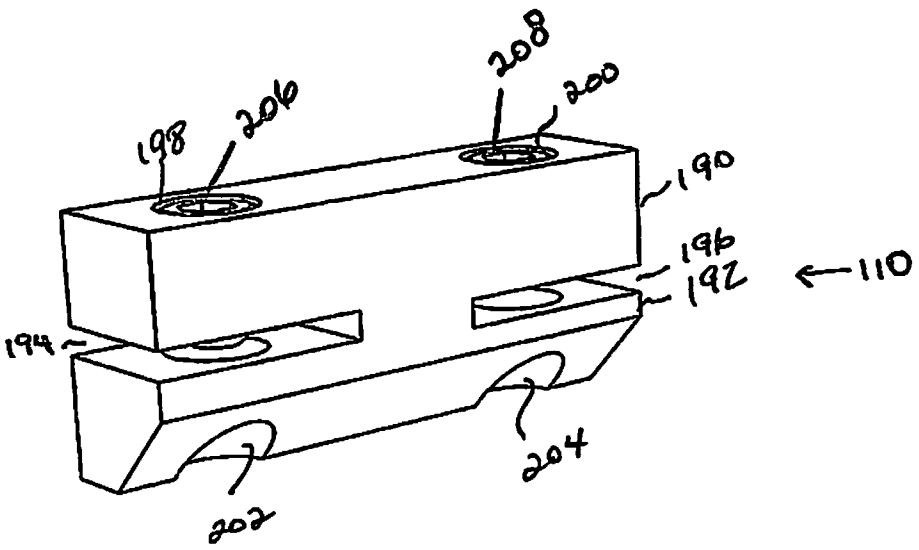
FIG. 8 is a perspective view of one embodiment of an interconnect clamp used in the LED array of FIG. 1.

As depicted in FIG. 8, one embodiment of the interconnect clamp 110 defines respective upper and lower portions 190, 192. Interconnect clamp slots 194, 196 are formed between the upper and lower portions 190, 192. Threaded interconnect clamp apertures 198, 200 are formed in the upper portion 190 and open into the respective slots 194, 196. Apertures 202, 204 are formed in the lower portion 192 and are aligned with the respective apertures 198, 200 in the embodiment depicted. The apertures 198, 200 accommodate interconnect clamp fasteners such interconnect clamp set screws 206, 208, or equivalent connectors. As in the case with respect to the mounting substrate 104 and power connect clamp 108, the interconnect clamp 110 may be formed from electrically connective material, such as copper, aluminum, or the like.

The LED array 100 is assembled by attaching a plurality of LED assemblies 102 to the mounting substrate 104 by extending mounting screws 106 through apertures 130, 132, then threading the screws 106 into the mounting apertures 164, 166. As shown in FIG. 1, adjacent LED assemblies 102 are disposed in alternating polarity such that the positive electrode of one LED assembly 102 is next to a negative electrode of an adjacent LED assembly 102. In one embodiment, the electrically insulative fasteners, e.g., screws 106, are fashioned from an electrically insulative material to maintain electrical isolation between the base of the LED assembly and the mounting substrate. One suitable insulative material is Ultem, a registered trademark for an amorphous thermoplastic polyetherimide (PEI) resin available from SABIC Innovative Plastics IP B.V. besloten vennootschap (b.v.) Netherlands Plasticslaan 1 Bergen op Zoom Netherlands 4612PX. Other suitable synthetic resins may be found by a person of ordinary skill in the art, for example, in the Handbook of Plastics, Elastomers, and Composites, Charles A. Harper, Editor in Chief, Third Edition, McGraw-Hill, New York, 1996, hereby incorporated by reference.

The plurality of LED assemblies 102 are interconnected in series by attaching adjacent positive and negative electrodes pairs to an interconnect clamp 110. Referring to FIG. 8, a positive electrode 120 is disposed within one of slots 194, 196 and a negative electrode 122 of an adjacent LED assembly 102 is disposed in the other of the slots 194, 196. The positive and negative electrodes are then secured in the slots 194, 196 by threading the screws 206, 208 until they are securely in contact with the electrodes. Alternatively, high compression spring-loaded contacts may be utilized in lieu of the threaded fasteners, each providing a gas-tight electrical connection. The LED assembly 144 may be utilized in lieu of the LED assembly 102, for example, if saving space is a consideration.

Referring now to FIG. 7, LED assemblies 102 at each end of the LED assembly 100, designated terminal LED assemblies 112, 114, are connected to an electrical power source, for example by securing a wire or other conductor positioned in an aperture 178 of the clamp 108 by means of tightening the set screw 184 within the threaded aperture 180 and tightening the set screw 186 in the aperture 182.

One of the LED assemblies 102 may be replaced for repair or to alter the wavelengths being emitted from the LED array 100. The LED assembly is removed by disconnecting the positive and negative electrodes from the interconnect clamps or from the interconnect clamp and power connect clamp, if the item being replaced is a terminal LED assembly. The LED assembly replacing the removed LED assembly is then attached to the interconnect clamps or to the interconnect clamp and power connect clamp as the case may be. The newly attached LED assembly is then attached to the mounting substrate by the extending the mounting screws through the apertures 130, 132 and threading them into the apertures 164, 166.

A person of ordinary skill in the art will recognize that both wire and spade-type electrical conductors can be connectively utilized by the assembly and method of this invention. Additionally, various densities of physical mounting may be attained by varying the dimensions and spacing of the LED assemblies. The various components described herein, and equivalents thereof, may withstand the high thermal and light energy environment produced when the LED assemblies are illuminated.

An alternative polarity mounting scheme is utilized to provide series connection of the LED devices, which is a highly efficient, space-saving assembly and interconnection method. If necessary, an individual LED assembly can be removed and exchanged with another individual LED assembly by loosening one or both of the brackets 108, 110 and removing the screws 106. The LED assembly intended to replace the removed LED assembly is then secured within one or both of the clamps 108, 110 and to the substrate 104 utilizing the set screws 106. This allows replacement of malfunctioning LED assemblies as well as on-site maintenance and alteration of wavelengths produced by the present LED array.

The present assembly and interconnection method of this invention provides "daisy chaining" in an alternate polarity series circuit by mounting the LED assemblies in an alternative polarity.

Due to the surface area of the LED assemblies of this invention and direct contact with a surface area of the mounting substrate, additional thermal transfer away from the LED heat source is provided.

Because numerous modifications of this invention may be made without departing from the spirit thereof, the scope of the invention is not to be limited to the embodiments illustrated and described. Rather, the scope of the invention is to be determined by the appended claims and their equivalents.

What is claimed is:

1. An LED array, comprising:

a mounting substrate;

a plurality of LED assemblies attached to the substrate, said plurality of LED assemblies including a pair of terminal LED assemblies, each of said LED assemblies including a positive electrode and a negative electrode electrically connected to an LED chip;

a pair of electrically conductive power connect clamps for connecting each of said terminal LED assemblies to an electrical power source, each of said power connect clamps including a slot defined between an upper portion and a lower portion and a power connect fastener threaded into a power connect clamp aperture, said positive electrode of a first of said pair of terminal LED assemblies is secured within said slot of a first of said pair of power connect clamps and said negative electrode of a second of said pair of terminal LED assemblies is secured within said slot of a second of said pair of power connect clamps; and a plurality of electrically conductive interconnect clamps connecting positive and negative electrodes of adjacent LED assemblies, each of said interconnect clamps including a pair interconnect clamp fasteners, each said interconnect clamp fastener threaded into an interconnect clamp aperture, said interconnect clamp fastener threaded against a positive or negative electrode to connect said positive and said negative electrodes of adjacent LED assemblies.

2. The LED array of claim 1, further comprising a plurality of electrically insulative fasteners attaching said LED assemblies to said mounting substrate.

3. The LED array of claim 1, wherein each of said interconnect clamps defines a pair of interconnect clamp slots and wherein said negative electrode of the first of said pair of terminal LED assemblies is disposed in a first of said pair of interconnect clamp slots and said positive electrode of an adjacent one of said LED assemblies is disposed in the second of said pair of interconnect clamp slots.

4. The LED array of claim 1, wherein said LED assemblies emit UV radiation.

5. The LED array of claim 1, wherein said mounting substrate and said interconnect clamp are electrically conductive.

6. The LED array of claim 1, wherein each of said LED assemblies has a pair of mounting apertures formed in a base, each of said mounting apertures accommodating a fastener threaded into an LED affixing aperture defined in said mounting substrate.

7. The LED array of claim 2, wherein said electrically insulative fasteners are screws disposed in threaded apertures defined in said mounting substrate.

8. The LED array of claim 2, wherein said insulative fasteners are formed from an amorphous thermoplastic polyetherimide.

9. A method of manufacturing an LED array, comprising:

attaching a plurality of LED assemblies to a mounting substrate by threading a pair of fasteners through each of said LED assemblies into a pair of apertures defined in said mounting substrate, said plurality of LED assemblies including a pair of terminal LED assemblies;

disposing a positive electrode of a first of said pair of terminal LED assemblies into a slot defined between an upper portion and a lower portion of a first electrically conductive power connect clamp; and disposing a negative electrode of a second of said pair of terminal LED assemblies into a slot defined between an upper portion and a lower portion of a second electrically conductive power connect clamp; threading a first power connect fastener into a power connect clamp aperture defined in the first electrically conductive power connect clamp;

threading a second power connect fastener into a power connect clamp aperture defined in the second electrically conductive power connect clamp;

connecting at least one adjacent LED assembly in series with at least one of said pair of terminal LED assemblies, wherein the step of connecting includes disposing a negative electrode of said first of said pair of terminal LED assemblies into a first slot defined in an interconnect clamp and disposing a positive electrode of said at least one adjacent LED assembly into a second slot defined in said interconnect clamp.

10. The method of claim 9, wherein said threaded fasteners attaching said LED assemblies to said mounting substrate are electrically insulative.

11. The method of claim 9, wherein each of said power connect clamps defines a power connect clamp aperture in communication with each of said first and second slots therein, and said interconnect clamp defines an interconnect clamp aperture, the method further comprising securing a threaded fastener in each of said interconnect clamp apertures and said power connect clamp apertures.

12. A method of replacing an LED assembly in an LED array, the LED array comprising a mounting substrate; a plurality of LED assemblies attached to the substrate, said plurality of LED assemblies including a pair of terminal LED assemblies, each of said LED assemblies including positive and negative electrodes electrically connected to an LED chip; a plurality of electrically conductive power connect clamps for connecting each of said terminal LED assemblies to an electrical power source, said power connect clamps including a power connect clamp fastener threaded into a power connect clamp aperture; and a plurality of interconnect clamps connecting positive and negative electrodes of adjacent LED assemblies, each of said interconnect clamps including a pair interconnect clamp fasteners and a pair of slots defined therein, a positive electrode of a first of said adjacent LED assemblies disposed in a first of said pair of slots and a negative electrode of a second of said adjacent LED assemblies disposed in a second of said pair of slots, each said interconnect clamp fastener threaded into an interconnect clamp aperture, said interconnect clamp fastener threaded against a positive or negative electrode to connect said positive and said negative electrodes of adjacent LED assemblies, said method comprising:

removing said fasteners from said mounting substrate;

removing said negative electrode of said LED assembly from one of said interconnect clamp slots;

removing said positive electrode of said LED assembly from another of said interconnect clamp slots;

attaching a replacement LED assembly to said mounting substrate;

inserting a negative electrode of said replacement LED assembly into said first of said pair of slots of said interconnect clamp; and inserting a positive electrode of said replacement LED assembly into said second of said pair of slots of said interconnect clamp.

13. The method of claim 12, further comprising threadably loosening said interconnect fasteners and said power connect fasteners.

14. The method of claim 12, wherein only a positive electrode or a negative electrode is removed from said interconnect clamp and wherein the other of said positive electrode or said negative electrode is removed from said power connect clamp and wherein one of said positive or said negative electrodes of said replacement LED assembly is connected to the interconnect clamp and the other of said positive or said negative electrodes of said replacement LED assembly is connected to said power connect clamp.

15. The method of claim 14, wherein said positive and said negative electrodes are removed and replaced by loosening and tightening said interconnect fasteners and said power connect fasteners.

16. A method of providing illumination from an LED array, the LED array comprising an electrically conductive mounting substrate; a plurality of LED assemblies attached to the substrate, said plurality of LED assemblies including a pair of terminal LED assemblies, each of said LED assemblies including positive and negative electrodes electrically connected to an LED chip; a plurality of electrically conductive power connect clamps, said power connect clamps including a power connect clamp fastener threaded into an power connect clamp aperture; and a plurality of interconnect clamps connecting positive and negative electrodes of adjacent LED assemblies, each of said interconnect clamps including a pair interconnect clamp fasteners, each said interconnect clamp fastener threaded into an interconnect clamp aperture such that said clamp fastener is in communication with a respective one of a pair of electrode receiving slots defined in the interconnect clamp, said interconnect clamp fastener threaded against one of a positive or a negative electrode disposed in one of said pair of electrode receiving slots to connect said positive and said negative electrodes of adjacent LED assemblies, said method comprising providing electricity each of said conductive power connect clamps.

* * * * *